US008307837B2

(12) United States Patent
Parker

(10) Patent No.: US 8,307,837 B2
(45) Date of Patent: Nov. 13, 2012

(54) STORAGE CASE

(75) Inventor: Philippe Parker, Zetjun (MT)

(73) Assignee: Toly Products (U.K.) Limited (GB)

( * ) Notice: Subject to any disclaimer, the term of this patent is extended or adjusted under 35 U.S.C. 154(b) by 98 days.

(21) Appl. No.: 12/752,169

(22) Filed: Apr. 1, 2010

(65) Prior Publication Data

US 2010/0252065 A1 Oct. 7, 2010

(30) Foreign Application Priority Data

Apr. 7, 2009 (GB) ..... 0906038.5

(51) Int. Cl.

| | |
|---|---|
| ***A45D 33/24*** | (2006.01) |
| ***B65D 43/14*** | (2006.01) |
| ***A45D 42/00*** | (2006.01) |
| ***A45D 40/24*** | (2006.01) |

(52) U.S. Cl. ..... 132/294; 132/315; 132/316; 132/317

(58) Field of Classification Search ..... 132/291, 132/293, 294, 295, 296, 300, 301, 304, 314, 132/315, 316; 206/45.23, 759; 220/817, 220/818, 820, 836, 841; 16/286

See application file for complete search history.

(56) References Cited

U.S. PATENT DOCUMENTS

| | | | | |
|---|---|---|---|---|
| 5,975,093 | A | 11/1999 | Joulia | |
| 5,992,426 | A * | 11/1999 | Yuhara | 132/293 |
| 6,240,930 | B1 | 6/2001 | Yuhara | |
| 7,422,018 | B2 | 9/2008 | Dieudonat | |
| 2006/0096611 | A1 | 5/2006 | Leppla et al. | |
| 2007/0080094 | A1 * | 4/2007 | Moon | 206/581 |
| 2007/0095687 | A1 | 5/2007 | Tsang | |
| 2007/0108094 | A1 | 5/2007 | Dieudonat | |
| 2008/0289645 | A1 | 11/2008 | Guillot | |
| 2009/0308408 | A1 * | 12/2009 | Winckels et al. | 132/295 |

FOREIGN PATENT DOCUMENTS

| | | |
|---|---|---|
| EP | 0910969 | 4/1999 |
| EP | 0910970 | 4/1999 |
| GB | 666592 | 2/1952 |
| GB | 1203501 | 8/1970 |

OTHER PUBLICATIONS

Combined Search and Examination Report in priority Application No. GB0906038.5.

European Search Report in Application No. 10157660.1.

* cited by examiner

*Primary Examiner* — Nicholas Lucchesi
*Assistant Examiner* — Niyati D Shah
(74) *Attorney, Agent, or Firm* — Dean W. Russell; Kristin M. Crall; Kilpatrick Townsend & Stockton LLP

(57) ABSTRACT

A case for cosmetic material and/or articles comprising a base, a lid, and a separate hinge member pivotally connecting the lid to the base. The hinge member defines a first hinge axis X-X with the base and a second hinge axis Y-Y (into the page) with the lid, wherein the first hinge axis is substantially perpendicular to the second hinge axis, and wherein the first hinge axis is offset from the second hinge axis.

11 Claims, 4 Drawing Sheets

STORAGE CASE

CROSS REFERENCE TO RELATED APPLICATION

This application claims priority to Great Britain Application No. 0906038.5 filed with the Intellectual Property Office of the United Kingdom on Apr. 7, 2009, the contents of which are incorporated herein by reference.

FIELD OF INVENTION

The present invention relates to a storage case, more particularly to a cosmetic case.

BACKGROUND

Handling conventional cosmetic cases (preferably cosmetic compacts having a base and a lid known in the art for application of cosmetic material by means of an applicator such as a brush or sponge) can be cumbersome and inconvenient. This can be particularly problematic when the cosmetic case has to be held by one hand leaving the other hand free to remove the applicator from the cosmetic case and apply the cosmetic. The hand holding the cosmetic case not only controls the orientation of the base of the cosmetic case but also the orientation of the lid to make use of the mirror on the inside of the lid. This can make the application of the cosmetic material awkward since holding the base in one orientation in order to gain access to the cosmetic material or applicator results in the orientation of the mirror attached to the lid providing limited field of view to the user. Any attempt to orientate the lid to provide maximum field of view so that the entire face can be seen would be counter intuitive since the base of the cosmetic case would then be orientated in such a way as to make access to the cosmetic material and/or applicator awkward.

U.S. Pat. No. 7,422,018 (Dieudonat, Fabrice) has attempted to overcome this problem by providing a cosmetic case quadrangular in shape with two approximately parallel sides gripped by the user when holding the case. The hinge connecting the lid to the base is located at one of the four corners of the cosmetic case such that when the case is opened, the lid in which the mirror is fitted is offset from the base. This has the advantage that when the cosmetic case is held by one hand on the parallel gripping sides to conveniently access the cosmetic material and/or applicator, the lid in which the mirror is fitted is conveniently orientated so that the entire face can be seen in the mirror without being hindered by the base.

Despite the improvements made, the cosmetic case described in U.S. Pat. No. 7,422,018 still suffers from the problem of having only one fixed orientation of the lid with respect to the bottom when in an open configuration. As a result, the maximum viewing potential of the cosmetic case can only be achieved when the bottom is held in one fixed orientation, i.e. by gripping the parallel gripping sides of the bottom, and thereby limiting the holding flexibility of the cosmetic case in any other orientation. For example, orientating the cosmetic case outside the normal holding position would inevitably result in the lid and thus mirror moving out of the maximum field of view. More importantly, the location of the hinge at one of the four corners of the cosmetic case means that the hinge is restricted to being either a "left hand" hinge which means that when the case is open, the lid equipped with the mirror is offset to the left from the base or a "right handed" hinge whereby the lid equipped with the mirror is offset to the right from the base. This has implications when the cosmetic case is to be used by either a left-handed person or a right-handed person. Any attempt to make the case adaptable to be used by a left-handed or right-handed person would mean major structural changes to the cosmetic case, i.e. shifting the hinge from one corner to the other depending upon whether the user is left-handed or right-handed. Thus, there is a need to manufacture two versions of cosmetic cases for use by a right-handed user or a left-handed user. Ultimately, this would have implications to the wholesale vendor as they have no guarantee on the number of purchasers who are left-handed or right-handed. Ball-type joints are known to be used that allow the lid of the cosmetic case to rotate about more than one axis independently of the base, i.e. for opening the cosmetic case as well as adjusting the orientation of the lid with respect to the base (see EP0910969 (L'Oreal)). The continuing rotation of the ball in its corresponding socket over a period of time eventually causes the ball to become loose in its socket, thereby removing any significant friction between the surface of the ball and the inner surface of the socket. This prevents the lid being held in any desired position relative to the base.

A cosmetic case is thus required which does not suffer from the above problems and which is able to provide maximum field of view in the mirror regardless of the orientation of the cosmetic case and yet adaptable to be used by both left-handed or right-handed people.

SUMMARY

The present applicant has mitigated the above problems by providing a case for cosmetic material and/or articles comprising a base; a lid; and a separate hinge member pivotally connecting the lid to the base; the hinge member defining a first hinge axis with the base and a second hinge axis with the lid; the first hinge axis being substantially perpendicular to the second hinge axis, and wherein the first hinge axis is offset from the second hinge axis. Having a separate hinge member connecting the lid to the base of the case and which defines a first hinge axis with the base that is substantially perpendicular to and offset from a second hinge axis with the lid, enables the lid to be orientated at any angle regardless of the orientation in which the base of the case is held. Moreover, having the first hinge axis being offset from the second hinge axis so that they do not lie in the same plane enables the lid to be swung to the left or right independent of the orientation of the base. Thus, when a mirror is fixed to the lid, the present invention provides the advantage of allowing the user to adjust the position of the mirror to provide maximum field of view regardless of the orientation in which the base of the cosmetic case is held in one hand.

The improved handling flexibility provided by the separate hinge member also allows the case of the present invention to cater for right-handed and/or left-handed users since the lid can be easily adjusted by a simple rotation about the second hinge axis so making the mirror offset to either the left or the right from the base.

Preferably the second hinge axis is inward of the first hinge axis when the case is in a closed configuration.

Optionally, the first hinge axis is provided by a hinge pin and the second hinge axis is provided by a snap-fit joint. The snap-fit joint ensures that there is sufficient friction to hold the lid in any desired position about its axis of rotation. Moreover, having two separate hinge axes that are offset, i.e. not lie in the same plane, each catering for the different degrees of rotation of the lid with respect to the base will lessen the wear on each hinge compared to having only one hinge mechanism catering for all degrees of rotation of the lid such as that provided by ball-type joints. Preferably, the hinge member comprises a stop to limit rotation of the lid about the first hinge axis so that the lid lies in a different plane to the base when in an open configuration of the case. Providing a stop in the form of a surface contactable with the base enables the lid to be held at an angle to the horizontal and thus when the user holds the base in a horizontal position to prevent its contents falling out, the mirror attached to the lid faces the user.

Preferably, the base comprises a rearward projection boss and the hinge member is rotatably attached to the projection by the hinge pin. More preferably, the hinge member interdigitates between two rearward projections on the base and the hinge pin is provided through the hinge member and the projections to define the first hinge axis. Optionally, the hinge member has an enlarged portion in which the hinge pin is located.

Optionally, the hinge member is connected to the lid by a snap-fit joint so as to provide a rotation axis of the lid about the hinge member, the rotation axis defining the second hinge axis. Preferably, the snap-fit joint comprises resilient fingers received in a corresponding hole in the hinge member. To prevent the lid from disengaging from the hinge member, the snap-fit joint may further comprises a locking plug.

BRIEF DESCRIPTION OF THE FIGURES

Further features and aspects of the invention will be apparent from the Claims and the following illustrative description of a cosmetic case and made with reference to the accompanying drawings in which:

DETAILED DESCRIPTION

Figure 1:
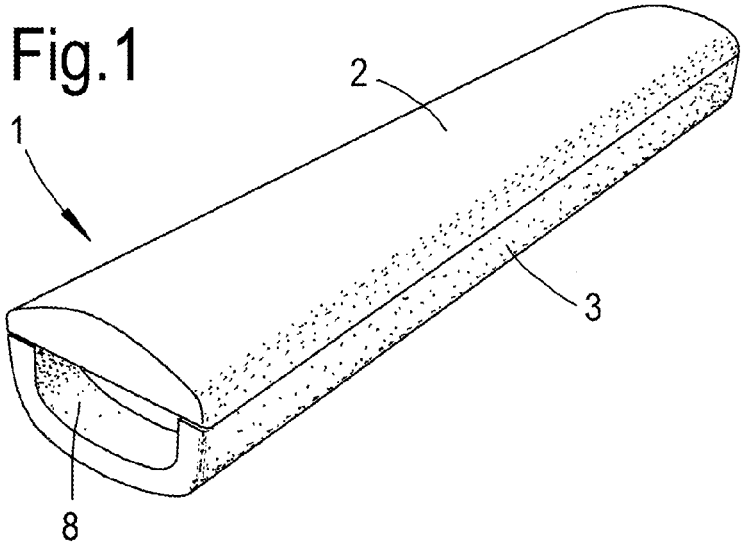
FIG. 1 is a schematic representation of a cosmetic case embodying the invention, shown in a closed configuration.

FIG. 1 shows an example of a case 1 embodying the present invention (see FIG. 1) for application of cosmetic material and which comprises a lid 2 and a base 3. The lid 2 is connected to the base 3 by a separate hinge member 4 (see FIG. 4). The base 3 shown in FIG. 2 comprises one or more depressions 5 for receiving cosmetic material such as cosmetic power, cosmetic liquid and/or for receiving cosmetic applicators such as brush, sponge and cosmetic pencils. The depressions are shown to be rectangular but other shapes configurations can be used, such as square, circular or oval. Attached to the inside of the lid 2 is a mirror 6 (see FIG. 2). In the particular embodiment, the cosmetic case is quadrangular, more particularly rectangular, in shape with two approximately parallel sides gripped by the user when holding the case similar to that shown in U.S. Pat. No. 7,422,018 (Dieudonat, Fabrice). This is to accommodate applicators having an elongated form such as an applicator brush for application of eyeliner or eye shadow, or cosmetic pencils. However, the hinge mechanism of the present invention is not necessarily restricted to quadrangular shapes and can find uses in other shaped cosmetic cases, e.g. circular, oval or rounded shapes.

Figure 2:
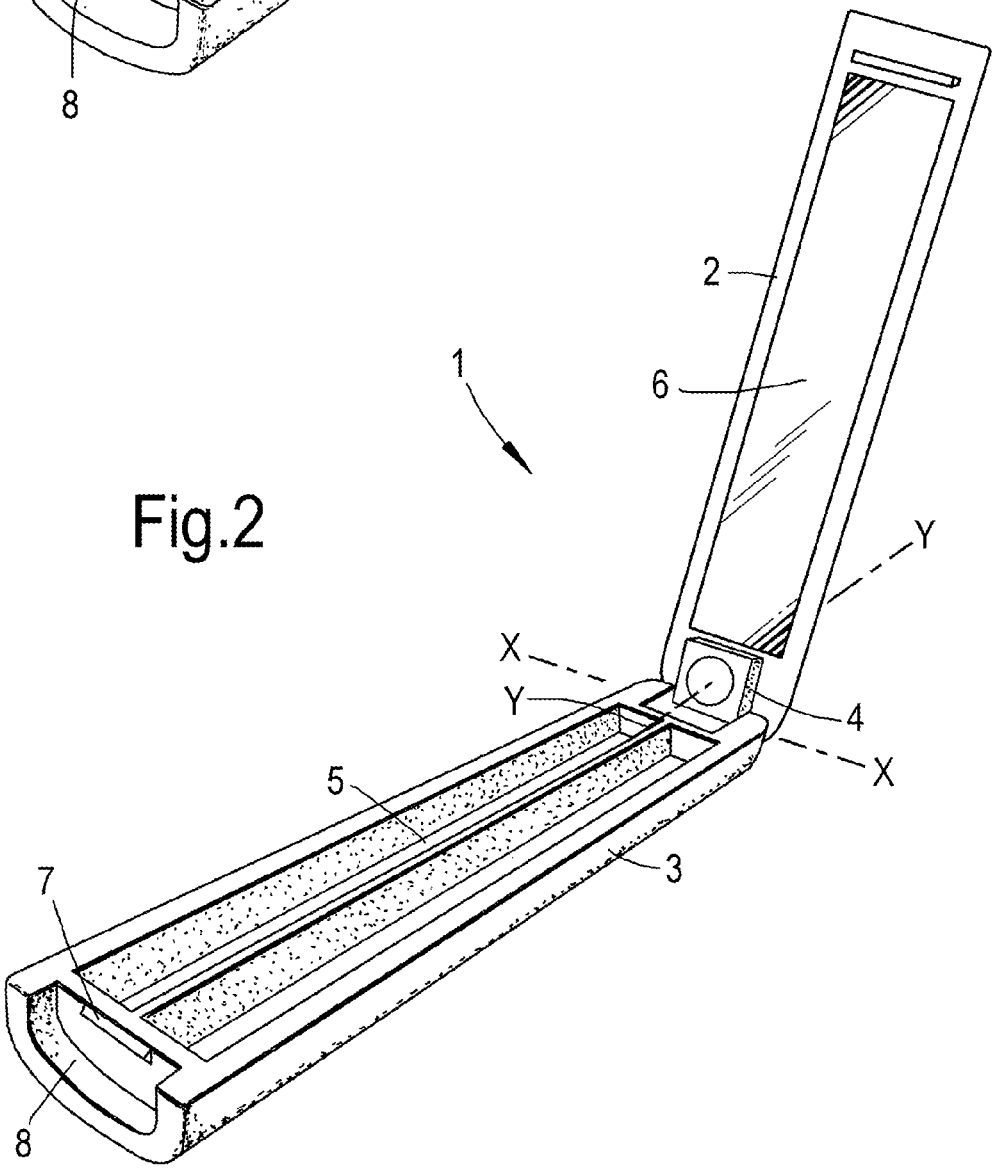
FIG. 2 is a schematic representation of the cosmetic case in an open configuration.
Figure 3:
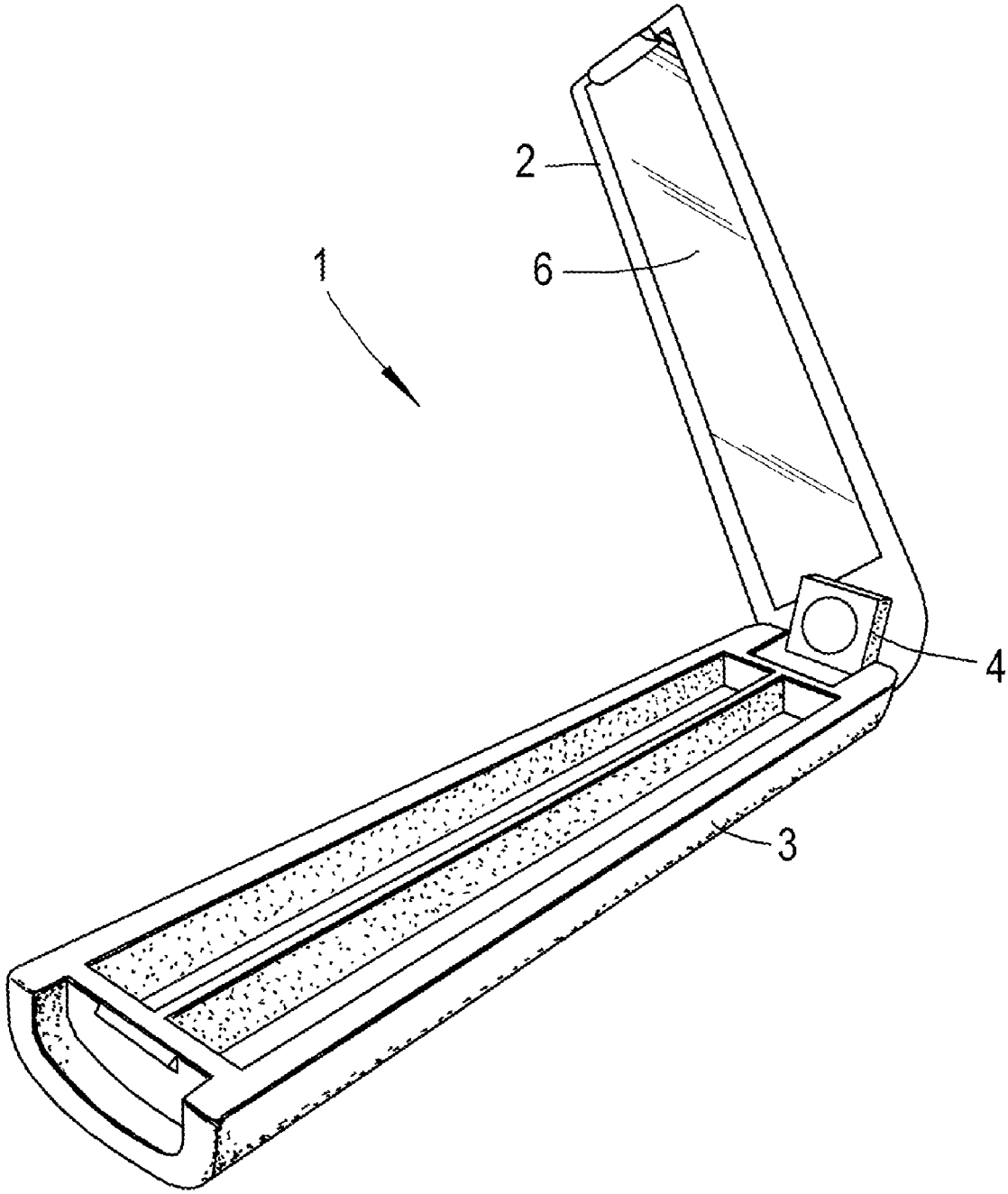
FIG. 3 is a schematic representation of the cosmetic case showing the lid offset to the left from the base.
Figure 4:
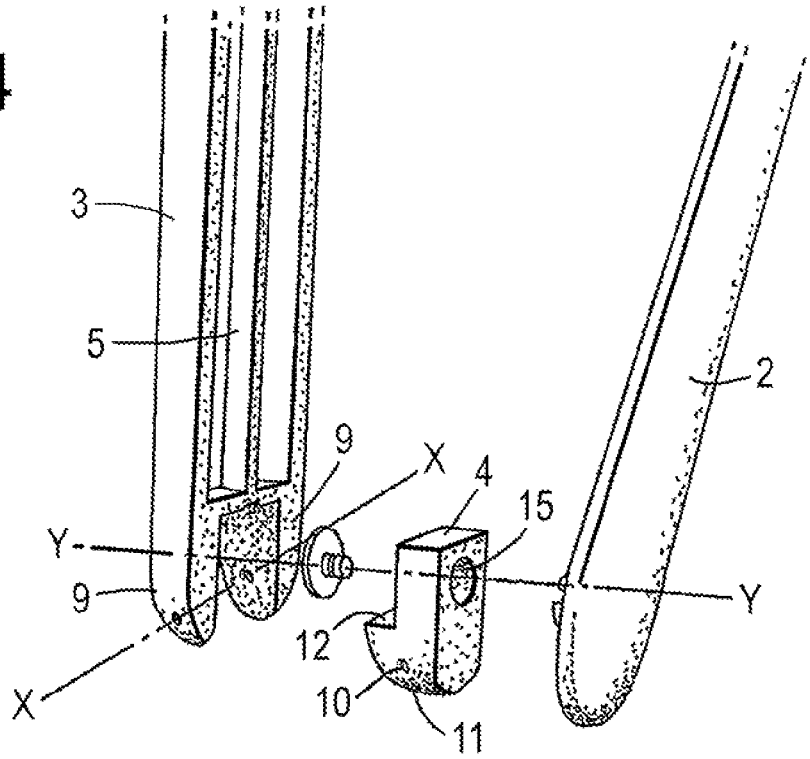
FIG. 4 is a perspective view of the components making up the case of the preceding figures.

In a closed configuration, the lid 2 and the base 3 are locked together by a locking mechanism. The locking mechanism in the specific embodiment comprises a snap-on arrangement 7 but other conventional types of locking mechanism can be used which are known in the art. The front wall of the base 3 containing the locking mechanism is formed with a recess 8 around the vicinity of the locking mechanism 7 to act as a finger hole for easy access to the locking mechanism. The lid 2 is connected to the base 3 by a separate hinge member 4 as shown in FIG. 4. The hinge member 4 defines a first hinge axis with the base represented by the axis X-X in FIG. 2 or FIG. 4 and a second hinge axis with the lid represented by the axis Y-Y in FIG. 4, the first hinge axis being substantially perpendicular to the second hinge axis so allowing the lid to freely rotate 360° about its second hinge axis. The first and second hinge axes are each being provided by a separate hinge and both hinge axes lie in different planes. This is different to ball-type joints as taught in prior art hinge mechanisms (see EP0910969 (L'Oreal)) where all the axes of rotation pass through a common point. In the particular embodiment, the first axis is provided by a hinge pin and the second axis by a snap-fit joint. By connecting the base 3 to the lid 2 by a separate hinge member 4 each connection having its own hinge axis for rotation relative to the hinge member 4 enables the lid 2 to rotate independently of the base 3. Thus, when the base 3 is held by one hand in one orientation, the lid 2 can easily be adjusted without being hindered by the base 3. When a mirror 6 is attached to the inside of the lid 2 as shown in FIG. 2, the mirror 6 can thus be adjusted to provide maximum field of view to the user so that the entire face can be seen. Moreover, the ability to rotate the lid 2 independently of the base 3 also provides the advantage that the case 1 of the present invention will cater for right-handed or left-handed users without any modification to the hinge member or its location on the case. As shown in FIG. 3, the lid 2 containing the mirror 6 is offset to the left from the base 3. Therefore whilst holding the base 3 by the right hand and the left hand being free to apply the cosmetic material, the lid 2 containing mirror 6 is offset from the left of the base 6 to provide maximum field of view in the mirror 6. Depending on the preferred hand holding the base 3 of the cosmetic case, the user can easily adjust the lid 2, by rotating the lid 2 about the first and second hinge axes, so as to provide the user with the maximum field of view in the mirror 6.

Figure 5:
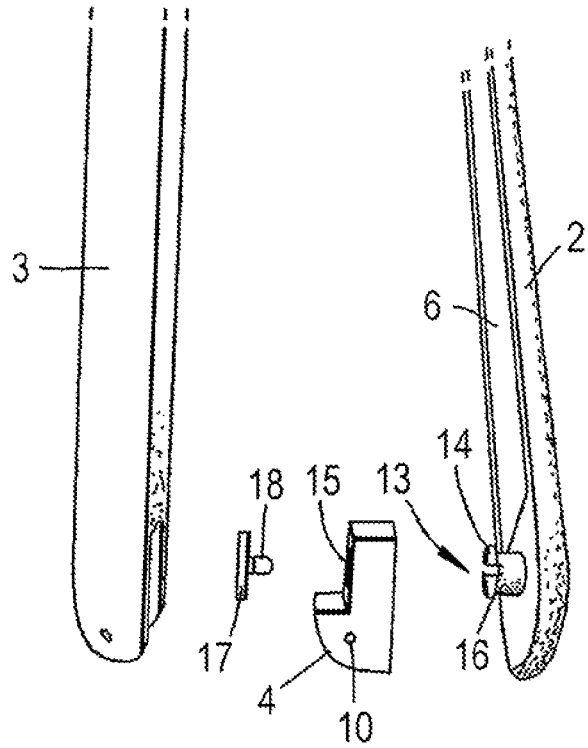
FIG. 5 is a side view of the components making up the case.

In the particular embodiment shown in FIG. 4, the hinge member interdigitates between two bosses or rearward projections 9 on the base 3 and a hinge pin (not shown) passes through holes 10 (see FIG. 5) in the hinge member 4 and the bosses 9 to connect the hinge member 4 to the base 3. The portion of the hinge member 4 connecting to the base 3 has an enlarged portion 11 in which the hinge pin is located. However, other means by which the hinge member 4 is connected to the base 3 known in the art are possible. For example, the base 3 can have only one boss which interdigitates between two lobes (not shown) provided on the hinge member 4.

The enlarged portion 11 of the hinge member 4 is shown as having a convex outer surface which lies between the two bosses 9 on the base 3. The curvature of the convex outer surface follows the path of rotation of the lid 2 and thus, hinge member 4 about the first hinge axis so allowing smooth rotation of the lid 3 about the hinge pin and a substantially flush fit between the outer surface of the hinge member 4 and the corresponding end of the base 3. Optionally, the hinge member 4 can also be provided with a "stop" 12 to limit rotation of the lid 2 when in an open configuration. The "stop" 12 provides a contactable surface with the base 3 around the vicinity of the hinge so that when the base 3 is held in a horizontal position, the lid 2 remains tilted at an angle and the mirror 6 attached to the inside of the lid 2 faces the user.

Figure 6:
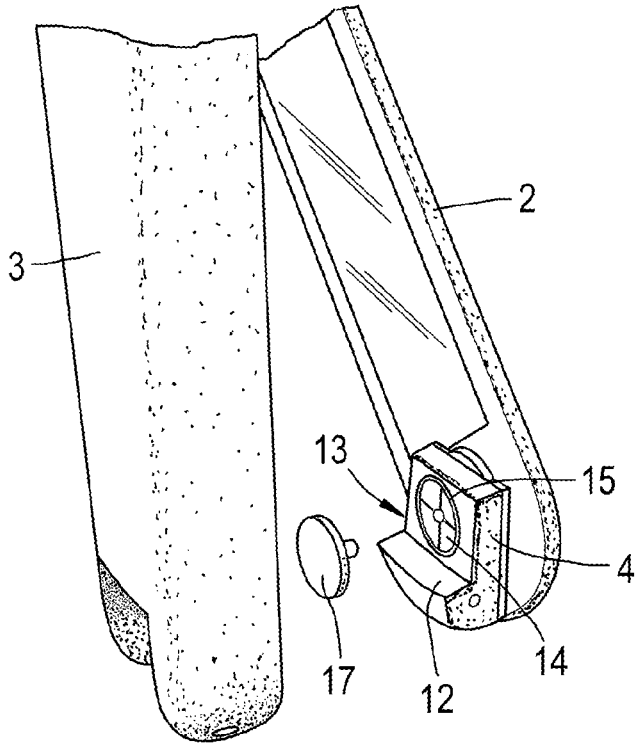
FIG. 6 is a perspective view showing the lid attached to the hinge member.
Figure 7:
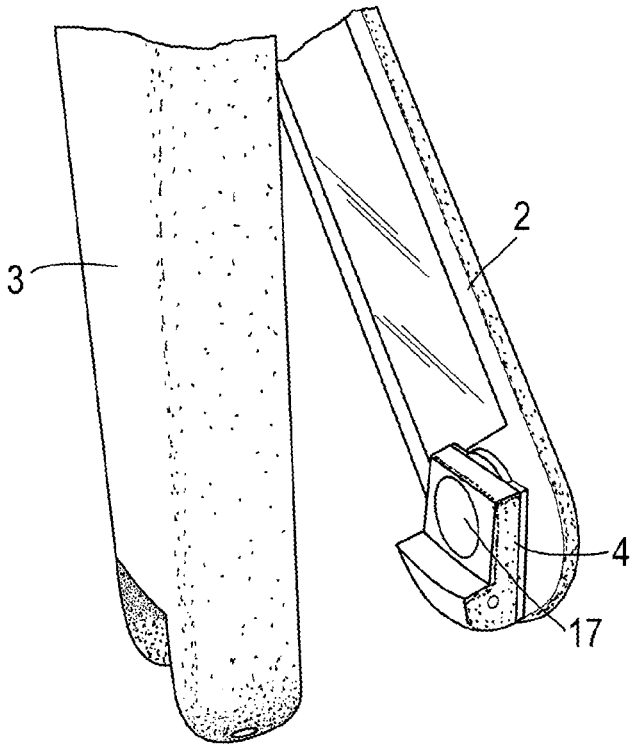
FIG. 7 is a perspective view showing the lid locked to the hinge member by a locking plug.

The lid 2 is connected to the hinge member 4 by a snap-fit joint 13 (see FIGS. 5 and 6) which comprises resilient fingers 14 that are received in a corresponding hole 15 in the hinge member 4 (see FIGS. 4 and 6). The end of the resilient fingers has an enlarged engaging head 16 to provide a locking surface when the resilient fingers 14 are inserted into the hole 15 of the hinge member 4. To prevent the lid 2 from disengaging from the hinge member 4, a locking plug 17 is also shown that is inserted between the resilient fingers 14 causing the resilient fingers to be prised apart in the hole and the enlarged engaging head 16 forms an area of greater diameter than the hole so as to lock the lid 2 to the hinge member 4 (see FIG. 6 showing the lid assembled onto the hinge member prior to insertion of the locking plug 17 and FIG. 7 showing the locking plug 17 inserted into the resilient fingers 14). The head of the plug 17 also provides a neat finish (flush with the surrounding surface of the hinge member 4) to the parts of the hinge member seen when the lid is open, covering the end of the hole 15 and the engaging head 16 of the fingers 14. The shaft 18 of the locking plug may also be formed with a ridged or knurled surface that engages with the resilient fingers 14 (e.g. via one or more complementary grooves) to prevent the locking plug from disengaging from the resilient fingers. Although not essential, the first hinge axis X-X is shown offset from the second hinge axis Y-Y. In the particular embodiment, to avoid interference of the second hinge axis Y-Y provided by the snap fit joint 13 with the first hinge axis X-X, the first hinge axis X-X is offset from the second hinge axis Y-Y. Other means known in the art for providing a pivotable connection between the hinge member 4 and the lid 2 so as to enable the lid to be rotated freely about the second hinge axis are permissible.

The invention claimed is:

1. A case for cosmetic material and/or articles comprising a base;

a lid;

the base and the lid each having an end that is adapted to receive a separate hinge member for pivotally connecting the lid to the base;

the hinge member defining a first hinge axis with the base and a second hinge axis with the lid, the first hinge axis being substantially perpendicular to the second hinge axis, and wherein the first hinge axis is offset from the second hinge axis, such that both hinge axes lie in different planes, wherein the hinge member is smaller than the lid and the base such that pivotal movement about the first hinge axis allows the lid to open and close directly against the base and wherein pivotal movement about the second hinge axis allows the lid to rotate about the hinge member, wherein the lid is connected to the hinge member by a snap-fit joint which comprises resilient fingers that are received in a corresponding hole in the hinge member;

wherein ends of the resilient fingers have an enlarged engaging head to provide a locking surface when the resilient fingers are inserted into the hole of the hinge member and a locking plug is inserted between the resilient fingers causing the resilient fingers to be prised apart in the hole and the enlarged engaging head to form an area of greater diameter than the hole so as to lock the lid to the hinge member, wherein the lid engages with the base when the lid is closed against the base.

2. The case as claimed in claim 1, wherein a shaft of the locking plug is formed with a ridged or knurled surface that engages with the resilient fingers to prevent the locking plug from disengaging from the resilient fingers.

3. The case as claimed in claim 1, wherein the first hinge axis is provided by a hinge pin.

4. The case as claimed in claim 3, wherein the base comprises rearward projections, the hinge member being rotatably attached to the projection by the hinge pin.

5. The case as claimed in claim 4, wherein the hinge member interdigitates between rearward projections on the base.

6. The case as claimed in claim 4, wherein the hinge pin is provided through the hinge member and the projections to define the first hinge axis.

7. The case as claimed in claim 3, wherein the hinge member has an enlarged portion in which the hinge pin is located.

8. The case as claimed in claim 1, wherein the hinge member comprises a stop contactable with the base to limit rotation of the lid about the first hinge axis.

9. The case as claimed in claim 1, wherein the hinge member is connected to the lid by said snap-fit joint to provide a rotation axis of the lid about the hinge member, the rotation axis defining the second hinge axis.

10. The case as claimed in claim 1, wherein the lid comprises a mirror.

11. The case as claimed in claim 1, wherein the base comprises one or more depressions for receiving cosmetic material and/or a cosmetic applicator.

* * * * *